United States Patent [19]

Krauss

[11] 3,991,783

[45] Nov. 16, 1976

[54] SYSTEM FOR RAPIDLY BUILDING AN AIR CUSHION OVER LIQUID IN A TANK

[76] Inventor: Hans Krauss, Jakob-Bleyer-Weg 13, 7920 Heidenheim (Brenz), Germany

[22] Filed: June 27, 1975

[21] Appl. No.: 591,110

Related U.S. Application Data

[63] Continuation-in-part of Ser. No. 335,156, Feb. 23, 1973, abandoned.

[52] U.S. Cl. ..... 137/209; 137/211.5

[51] Int. Cl.[2] ..... E03B 5/00

[58] Field of Search ..... 137/208, 209, 211.5

[56] References Cited

UNITED STATES PATENTS

| | | | |
|---|---|---|---|
| 2,845,082 | 7/1958 | Kracht et al. | 137/209 |
| 3,163,114 | 12/1964 | Kracht | 137/209 |
| 3,297,236 | 1/1967 | Eckerle et al. | 137/211.5 |

FOREIGN PATENTS OR APPLICATIONS

| | | | |
|---|---|---|---|
| 208,710 | 4/1960 | Austria | 137/209 |
| 1,369,266 | 6/1964 | France | 137/209 |
| 1,092,595 | 4/1955 | France | 137/209 |
| 1,073,405 | 1/1960 | Germany | 137/209 |

*Primary Examiner*—Alan Cohan
*Assistant Examiner*—Gerald A. Michalsky
*Attorney, Agent, or Firm*—Steinberg and Blake

[57] ABSTRACT

A system for rapidly building an air cushion over liquid in a tank, without requiring an air compressor for this purpose. During normal operation the air cushion over the liquid is maintained at a given magnitude and pressure by cyclical operation of an air-supply tank at a given normal rate. This air-supply tank is operated by the method and apparatus of the invention at a faster than normal cyclical rate for the purpose of rapidly building up the air cushion when the liquid-supply tank which has the air cushion situated over liquid therein is initially installed or is set up for operation after inspection, repairs, or the like.

10 Claims, 12 Drawing Figures

SYSTEM FOR RAPIDLY BUILDING AN AIR CUSHION OVER LIQUID IN A TANK

CROSS REFERENCE TO RELATED APPLICATION

This application is a continuation-in-part of previously copending but now abandoned application Ser. No. 335,156, filed Feb 23, 1973.

BACKGROUND OF THE INVENTION

The present invention relates to liquid-supply tanks wherein a liquid is maintained in the tank beneath an air cushion which is under pressure for the purpose of not only maintaining a relatively constant pressure on the liquid but also equalizing pressure variations which might otherwise occur.

In particular, the present invention relates to a system for rapidly building up the air cushion over the liquid in the tank under conditions where the latter is initially installed or is being set up for operation after inspection, repair, or the like.

Moreover, the present invention relates to a system according to which the air cushion once it is established is maintained over the liquid in the liquid-supply tank.

Associated with the liquid-supply tank is an air-supply tank which communicates with the liquid-supply tank for maintaining the air cushion therein during normal operation. Flow of liquid between these tanks is controlled by a valve such as a pressure-responsive valve which responds to pressure in the liquid-supply tank.

Methods and apparatus of the above type are already known, for example, in the form of compressors which are utilized for the initial buildup and maintaining of the air cushion over the liquid in the liquid-supply tank. However, such conventional arrangements are disadvantageous in that the installations are expensive and subject to frequent faulty operation.

There are other known methods and apparatus of the above type where instead of a compressor there is provided an air-supply tank connected in parallel with the liquid-supply tank with suitable control valves being provided so that with such an arrangement also it is possible to maintain a given air cushion over the liquid in the liquid-supply tank. However, arrangements of this latter type are exceedingly disadvantageous in that in order to initially build up the air cushion, an extremely long time is required because the volumetric efficiency of such installations is extremely low.

SUMMARY OF THE INVENTION

It is accordingly a primary object of the present invention to provide a system which will avoid the above drawbacks.

In particular, it is an object of the present invention to provide a system according to which it becomes possible to build up very rapidly an air cushion over liquid in a liquid-supply tank without, however, requiring the use of a compressor for this purpose.

Thus, it is an object of the present invvention to provide a system according to which both the initial formation of the air cushion and the maintenance of the latter during normal operation can be accelerated as compared with conventional method and apparatus designed for the same purposes.

Furthermore, it is an object of the present invention to provide a system of the above type which will operate at an efficiency which is far higher than has heretofore been possible.

With the system of the invention when the liquid-supply tank is initially installed or is set up for operation after having been inspected, repaired, or the like, it is first almost entirely filled with liquid under pressure and then by way of an air-supply tank which is operatively connected with the liquid-supply tank cyclical operations are carried out to provide the air cushion over the liquid in the liquid-supply tank. These cyclical operations go forward at a given normal rate during normal operation of the system after the air cushion has been established. However, when the air cushion is initially being formed under any of the above conditions, the air-supply tank is operated at a rate which is faster than its normal rate of cyclical operation, for the purpose of achieving the rapid buildup of the air cushion.

For the purpose of the rapid cyclical operation of the air-supply tank, it can be operated without interruption from one cycle to the next. The cyclical operations go forward automatically in response to detection of upper and lower pressure limits in the liquid-supply tank, and according to the invention during the rapid cyclical operation when the air cushion is initially being formed the pressure is dropped from the upper limit to the lower limit in the liquid-supply tank at a rate which is much faster than required for this pressure drop during normal operation. The air-supply tank takes on a charge of air at each cycle, with this charge of air being transferred to the liquid-supply tank to participate in the formation or maintenance of the cushion therein also during a part of each cycle. However, with the system of the invention the liquid in the liquid-supply tank is connected to a discharge pipe while a charge of air flows into the air-supply tank at each cycle. Also, before liquid is transferred from the liquid-supply tank to the air-supply tank to displace air from the latter to the cushion in the liquid-supply tank, the communication between the liquid in the liquid-supply tank and its discharge pipe is terminated.

According to a known method and apparatus, a control valve is provided in such a way that in one position there is communication between the liquid in the liquid-supply tank and the air-supply tank while at the same time the discharge pipe of the air-supply tank, which operates at atmospheric pressure, is closed. In another position of this control valve the flow of liquid from the liquid-supply tank to the air-supply tank is blocked and the connection between the air-supply tank and its discharge pipe is provided. At the same time an air-inlet valve at an upper portion of the air-supply tank is opened, so that the liquid which discharges out of the air-supply tank can at the same time suck air into the latter.

However, according to the invention both of the tanks respectively have discharge pipes which are closed when a control valve means provides communication between the tanks so that liquid can flow from the liquid-supply tank to the air-supply tank to displace a charge of air therein from the air-supply tank to the air cushion in the liquid-supply tank.

According to the invention the tanks communicate with each other through an air-conduit means having therein a non-return valve means which automatically responds to pressure in the tanks for controlling the flow of air from the air-supply tank to the liquid-supply tank while preventing a reverse flow of fluid, this non-return valve of the invention operating automatically without any exterior controls as was heretofore provided. Therefore, any air compressed in the air cushion cannot even to the slightest extent become lost to the exterior. Furthermore, air is not, as was previously done, sucked into the air-supply tank from teh outer atmosphere through such a valve, but instead the air flows upwardly into the air-supply tank through the very same pipes which are used to discharge liquid therefrom and in this way it is possible to fill the air-supply tank with a new charge of air at a rate which is much faster than has heretofore been possible. In an actual construction with an arrangement of this type, particularly without any dead space as is unavoidable with conventional arrangements, as well with the elimination of any lack of fluid-tightness, the volumetric efficiency was increased from 26 to 84 percent.

BRIEF DESCRIPTION OF DRAWINGS

The invention is illustrated by way of example in the accompanying drawings which form part of this application and in which.

DESCRIPTION OF PREFERRED EMBODIMENTS

Figure 1A:
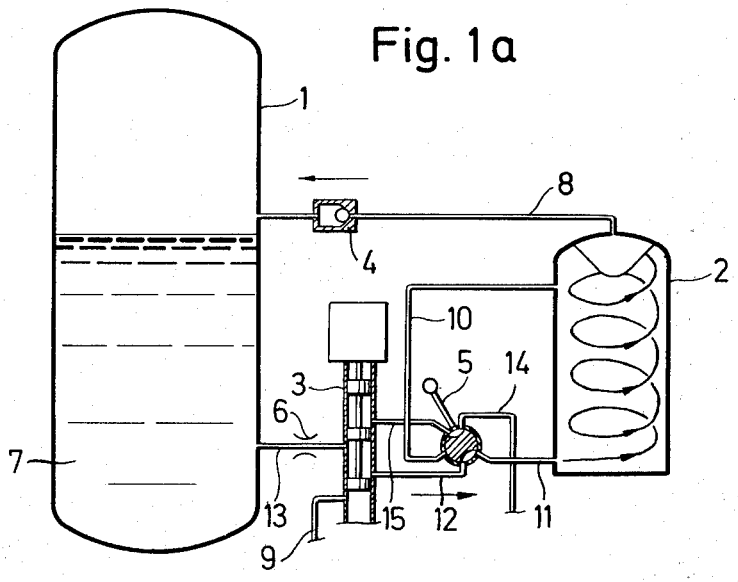
FIGS. 1*a* and 1*b* respectively illustrate, in a schematic manner, low pressure and high pressure operation of the system of the invention when the rapid cycle operation is being carried out.

For the sake of clarity in FIGS. 1*a*–3*b* the liquid-supply pump and the pressure connection thereto as well as the liquid-supply pipe from the liquid-supply tank are omitted, these features as well as additional features being shown in FIG. 5 and referred to below. Moreover, those components which carry out the same functions in various embodiments are indicated by the same reference characters.

In FIGS. 1*a*–3*b*, there is schematically illustrated a liquid-supply tank 1 as well as an air-supply tank 2. Between these tanks there is a valve means which includes a pressure-responsive valve means 3 which automatically responds to pressure in the tank 1. The valve means 3 may be automatically operated in response to pressure in the tank 1 either pneumatically, hydraulically, or electrically. The tanks 1 and 2 have upper air chambers which communicate with each other through an air-conduit means 8. These tanks 1 and 2 also have lower liquid chambers which can also be placed in communication with each other. For this purpose the liquid-supply tank 1 has a lower pipe 13 while the air-supply tank 2 has a lower pipe provided with an upper portion 10 and a lower portion 11. These lower pipes of the tanks are situated at an elevation lower than the air-conduit means 8. The lower pipes of the tanks are interconnected by way of the valve means which includes the pressure-responsive valve means 3, the change-over valve means 5, and the valve conduit means 12, 15 extending therebetween in the embodiment of FIGS. 1*a*–2*b*. Thus, through the lower pipe 13, the valve conduit 12, and the lower pipe portion 11 it is possible for the tanks 1 and 2 to communciate with each other when the valves 3 and 5 have the position shown in FIG. 1*a*. The pressure-responsive valve means 3 is a spool-type of valve having upper and lower valve chambers separated by spool portions as illustrated. In the position of the parts shown in FIG. 1*a*, the lower spool portion of the valve 3 provides communication between the pipes 13 and 12 while the change-over valve means 5 provides communication between the valve conduit 12 and the lower pipe portion 11 of the air-supply tank 2. The valve 5 is shown in FIGS. 1*a* and 1*b* in its rapid-cycle position when the air cushion over the liquid 7 in the liquid-supply tank is being built up, while the pressure-responsive valve means 3 is shown in its low pressure position in FIG. 1*a* and in its high pressure position in FIG. 1*b*. The valve 3 automatically assumes the low pressure position of FIG. 1*a* when the pressure in the tank 1 falls to a given lower limit, while the valve 3 assumes the high pressure position of FIG. 1*b* when the pressure in the tank 1 reaches a given upper limit. In the high pressure position of FIG. 1*b* the upper spool portion of the valve 3 provides communication between the pipe 13 and the valve conduit 15 which in the rapid-cycle position of tthe valve 5 shown in FIG. 1*b* communicates with the liquid-supply tank discharge pipe 14. This discharge pipe 14 for the tank 1 communicates with a reservoir as described below in connection with FIG. 5. In the rapid-cycle position of the change-over valve means 5 shown in FIGS. 1*a* and 1*b*, the lower pipe portion 11 of the lower pipe of the air-supply tank 2 communicates with the valve conduit 12, while in the normal cycle position of the change-over valve means 5, shown in FIGS. 2*a* and 2*b*, the lower pipe portion 11 is closed and the upper pipe portion 10 of the lower pipe of the air-supply tank 2 communicates with the valve conduit 12.

Figure 1B:
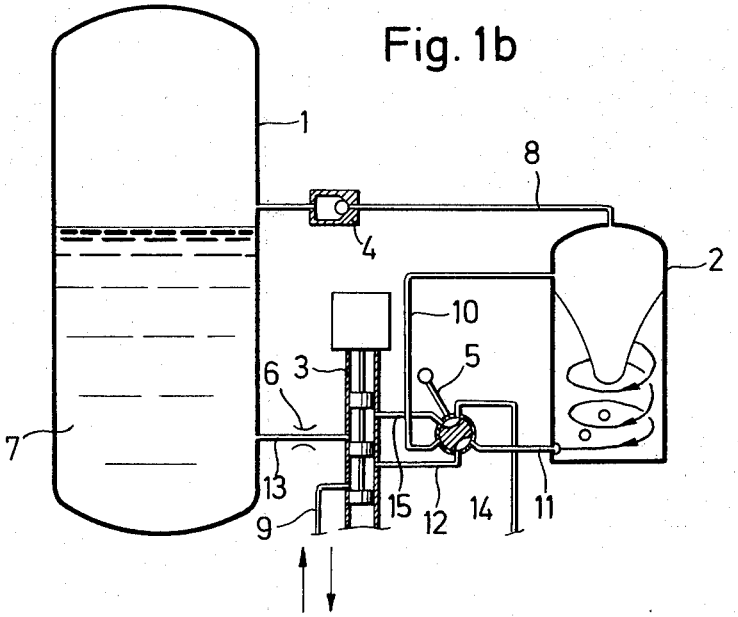

Thus, it will be seen that in FIGS. 1*a* and 1*b* the change-over valve means is shown in the rapid-cycle position for rapidly buidling up the air cushion over the liquid 7 in the liquid-supply tank 1. In FIG. 1*a* the parts are shown in the low-pressure position of the pressure-responsive valve means 3. In other words when the pressure in the tank 1 reaches a given lower limit the valve means 3 automatically responds to assume the position shown in FIG. 1*a*. In the position shown in FIG. 1*a*, the liquid 7 which is under pressure flows out of the tank 1 through the lower pipe 13 thereof and then through the valve means 3 to the valve conduit 12 from where the liquid under pressure flows through the lower pipe portion 11 of the lower pipe of the air-supply tank 2 into the latter. Thus, the liquid under pressure rises upwardly along the interior of the air-supply tank 2 in order to displace air out of the latter through the air-supply conduit means 8 into the tank 1 to increase the volume of the air-cushion therein. Previously to receiving the liquid from the tank 1 the tank 2 received a new charge of air which was at atmospheric pressure and of course this charge of air is compressed by the rising liquid received from the tank 1. The air in the tank 2 is initially compressed at a rapid rate and then as the pressure increases the rate of compression becomes gradually slower. As soon as the pressure in the tank 2 reaches the pressure of the cushion in the tank 1, the non-return valve means 4 carried by the air-conduit means 8 automatically opens and because the bodies of liquid in the tanks 1 and 2 will assume the same elevation at their surfaces, when the tanks 1 and 2 communicate with each other in the same way as any communicating containers having liquids therein, the compressed air in the tank 2 flows through the air-conduit means 8 into the tank 1.

Pumping liquid into the tank 1 will increase the pressure therein up to a predetermined upper limit, and now when this upper pressure limit is reached the pressure-responsive valve means 3 will automatically respond to assume the high pressure position shown in FIG. 1*b*. In the position of the part shown in FIG. 1*b* the lower pipe portion 11 of the tank 2 still communicates with the valve conduit 12 through the change-over valve means 5. It will be seen that the changed position of the pressure-responsive valve means 3 has now placed the valve conduit 12 in communication with the discharge pipe 9 of the air-supply tank 2. Therefore, the interior of the tank 2 is placed in communication with the outer atmosphere and the liquid therein can flow freely out through the pipes 11, 12 and 9. Of course, this position of the parts will provide an immediate drop in the pressure in the tank 2 so that the non-return valve means 4 automatically closes in response to the greater pressure prevailing in the tank 1. Thus, the tank 2 will automatically empty through the pipes 11, 12, and 9, and at the same time air bubbles into the tank 2 while the liquid simultaneiously flows out of the latter. Thus the new charge of air is received through the pipes 9, 12 and 11 as the liquid flows out of the tank 2.

Moreover, it will be seen that in the high pressure position of the pressure-responsive valve means 3 of FIG. 1*b*, the lower pipe 13 of the tank 1 communicates through the valve 3 with the upper valve conduit 15 and through the latter with the discharge pipe 14 of the liquid-supply tank 1. Thus liquid under pressure is emptied from the tank 1 simultaneously with emptying of liquid from the tank 2 while a new charge of air is received in the latter. Thus, through the upper spool chamber of the valve 3 the liquid under pressure from the tank 1 is being discharged, through the lower spool chamber of the valve 3 the liquid from the tank 2 is simultaneously discharged.

Of course, this discharge of liquid out of the tank 1 through the discharge pipe 14 thereof will provide a fairly rapid drop in pressure in the tank 1, so that the lower pressure limit at which the pressure-responsive valve means 3 responds is achieved in a short time and the pressure-responsive valve means 3 will now return to the low pressure position of FIG. 1*a*, so that the structure operates cyclically through a series of the above cycles to rapidly increase the volume of the air cushion over the liquid 7 in the tank 1.

Figure 2A:
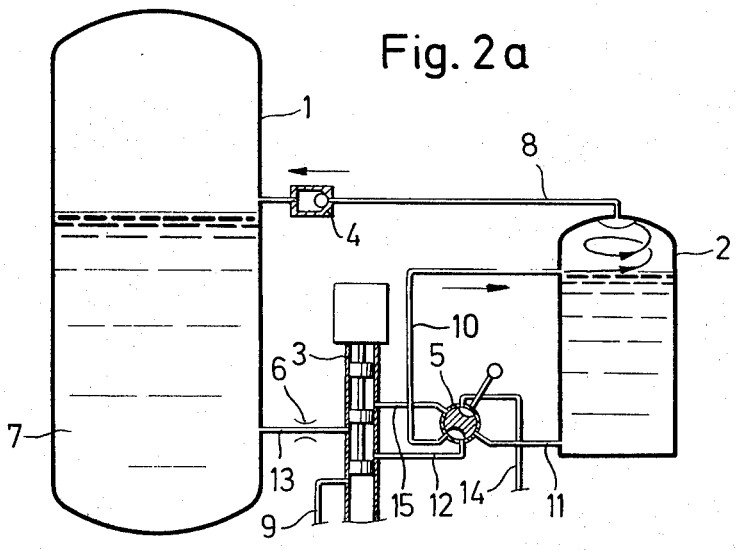
FIGS. 2*a* and 2*b* also respectively illustrate in a schematic manner low pressure and high pressure operation, respectively, but during the normal cycle operation.
Figure 2B:
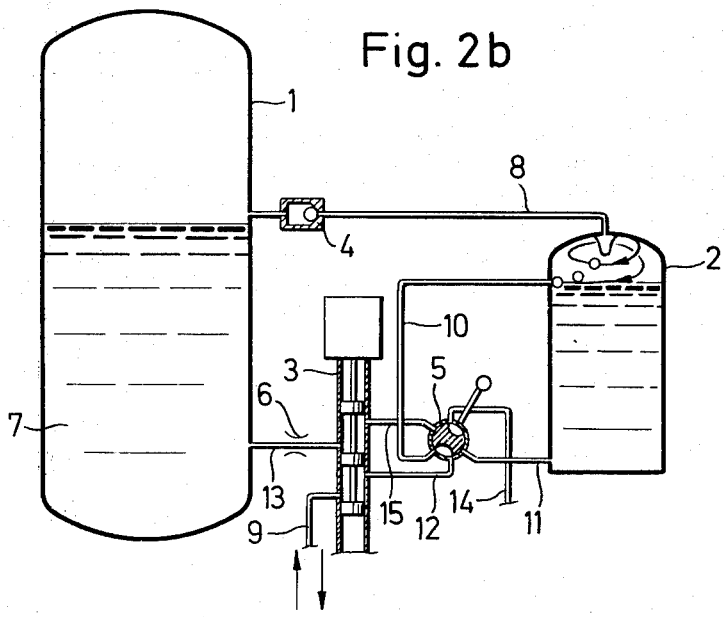

FIGS. 2*a* and 2*b* show the structure in the position where the change-over valve means has been changed over to the normal cycle position in which the previously established air cushion is maintained. It will be noted that in this normal cycle position of the valve means 5 the lower portion 11 of the lower pipe of the air-supply tank 2 is closed so that all of the operations take place through the upper portion 10 of the lower pipe of the tank 2. As a result the filling in of liquid under pressure and the discharge of liquid takes place only with a part of the volume of the tank 2, namely the part thereof which is at a higher elevation than the connection of the pipe 10 to the tank 2. Thus, the pressure-responsive valve means 3 will still respond in the same way to the upper limit of the pressure in the tank 1 to assume the high pressure position shown in FIG. 2*b* and to the lower limit of the pressure to assume the position shown in FIG. 2*a*, but whenever a charge of air is compressed out of the tank 2 into the tank 1, it is only the air in the tank 2 at an elevation above the elevation of the connection of the pipe 10 thereto, as is apparent from FIG. 2*a*, which is delivered to the tank 1 in order to increase the volume of air therein while pump 20 (FIG. 5) pumps liquid into the tank 1 until the upper limit is reached whereupon the valve means 3 responds to assume the position shown in FIG. 2*b*. It will be noted that in the position of valve means 5 of FIGS. 2*a* and 2*b*, the discharge pipe 14 is permanently closed.

Figure 3A:
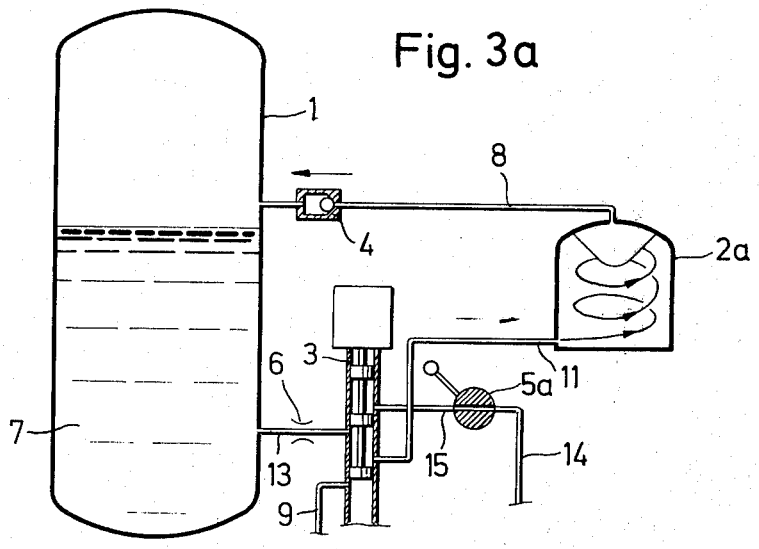
FIGS. 3*a* and 3*b* respectively illustrate also in a schematic manner low pressure and high pressure operation of another embodiment during the rapid cycle phase when the air cushion is being initially formed.
Figure 3B:
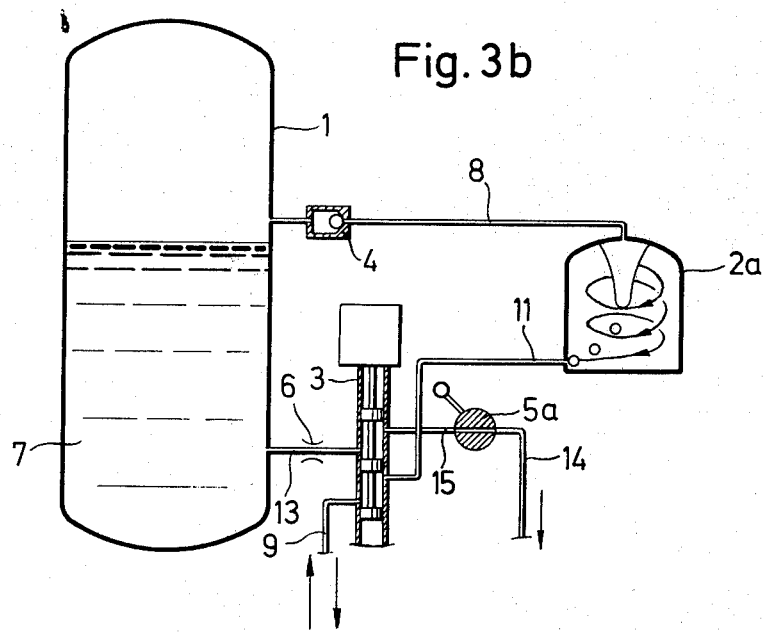

FIGS. 3*a* and 3*b* show a simplified embodiment where the tank 2*a* only has one lower pipe 11 connected thereto. Thus the pipe portion 10 of FIGS. 1*a*–2*b* is omitted in the embodiment of FIGS. 3*a* and 3*b*. Moreover, instead of a multiple-way valve 5, the change-over valve means 5*a* of FIGS. 3*a* and 3*b* is a simple valve capable only of closing and opening the discharge pipe 14 of the liquid-supply tank 1 in order to connect and disconnect the discharge pipe 14 from the valve conduit 15. The change-over valve means 5*a* as shown in FIGS. 3*a* and 3*b* in the rapid-cycle position where the air cushion will be built up rapidly in the manner described above in connection with FIGS. 1*a* and 1*b*. When the change-over valve means 5*a* is displaced to the normal cycle position, the communication between the pipes 14 and 15 is interrupted, with the parts operating as described above in connection with FIGS. 2*a* and 2*b*.

It will be noted that in all of the embodiments of the invention, the high and low pressure positions of the pressure-responsive valve means 3 and the rapid cycle and normal cycle positions of the change-over valve means 5 provides for a control valve means formed by this assembly four different possible phases of operation. It is only in that phase where the change-over valve means is in its rapid cycle position and the pressure-responsive valve means is in its high pressure position that the discharge pipe 14 communicates with the tank 1 in order to empty liquid under pressure therefrom. In all other three phases it will be noted that the pipe 14 does not communicate with the tank 1.

Of course, the embodiment of FIGS. 1*a*–2*b* will present certain advantages over the simplified embodiment of FIGS. 3*a* and 3*b*. However, in general it is possible with all of the above-described embodiments of the invention to achieve in the rapid-cycle position of the valve a plurality of operating cycles in rapid sequence which will result in a rapid buildup of the cushion of desired magnitude and pressure over liquid in the tank 1. With the embodiment of FIGS. 1*a*–2*b*, it is possible to increase the efficiency from 26 percent for conventional arrangements up to 93 percent for the present invention. This increase in efficiency is achieved primarily by eliminating the requirement of using a compressor and instead initially establishing the air cushion by the rapid cyclical operation of the air-supply tank as described above. By utilizing a tank 2 as shown in FIGS. 1*a*–2*b* which is of sufficient magnitude it is possible to reduce the time required for rapid buildup of the air cushion, with an arrangement being possible according to the invention where the time required for rapid buildup of the air cushion is no greater than that required with conventional less efficient arrangements where a special compressor is utilized for this purpose.

Figure 7:
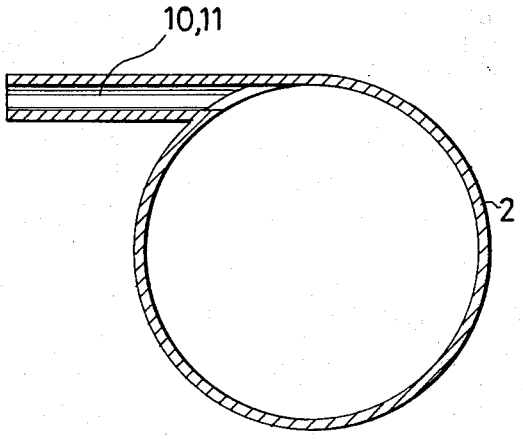
FIG. 7 is a schematic sectional illustration of tangential connections forming part of the invention.

As is apparent from FIG. 7, the pipe portions 10 and 11 communicate tangentially with the tank 2. By way of the upper pipe portion 10 only a part of the volume of the tank 2 will have the air therein compressed. As is apparent from FIGS. 2*a* and 2*b*, below the elevation of the connection of the pipe 10 to the tank 2 the latter is not emptied and the body of liquid which remains therein serves to reduce the volume of the tank 2. In this way a suitable volume required for maintenance of the air cushion is achieved this latter volume being substantially less than that used for the rapid buildup of the air cushion according to the invention. It will be noted from FIGS. 2*a* and 2*b* that in the illustrated position of the parts the pipes 14, 15 and 11 are closed.

Figure 8:
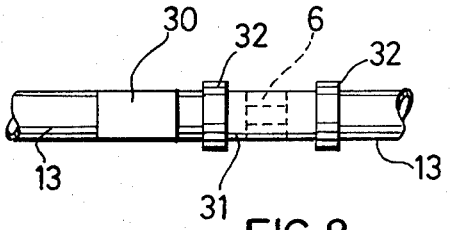
FIG. 8 is a schematic illustration of an interchangeable throttle valve which is used with part of the structure of the invention.

As is schematically indicated in FIGS. 1*a*–3*b* and as is shown in greater detail in FIG. 8, the lower pipe 13 of the tank 1 carries an interchangeable throttle means 6. Thus as is shown in FIG. 8, the pipe 13 can be provided with a valve 30 which when closed enables through the fittings 32 the support 31 which carries the throttle plate 6 to be removed and replaced by a different unit having a throttle aperture of a different size. Thus the members 6 will have an opening of a given size, and by selecting a suitable throttle means 6 it is possible to control the speed with which the tank 2 is filled with liquid to compress the charge of air in the tank 2 and displace the charge of air from the tank 2 into the tank 1 as described above. Moreover, not only is the speed of filling of the tank 2 determined through selection of a throttle means 6 of a suitable size, but in addition the speed with which the tank 1 empties during the rapid cycle operation in order to have the pressure drop rapidly from the upper limit to the lower limit can also be controlled. Of course, after a valve member with a throttle aperture of a selected size is replaced in the arrangement shown in FIG. 8, the valve 30 is opened so that the operations can resume. Because of the different pressure relationships the time required to fill the air-supply tank 2 with the pressure liquid flowing through the throttle means 6 is longer than the time required to bring about in the tank 1 a drop in pressure from the upper limit to the lower limit.

Figure 4A:
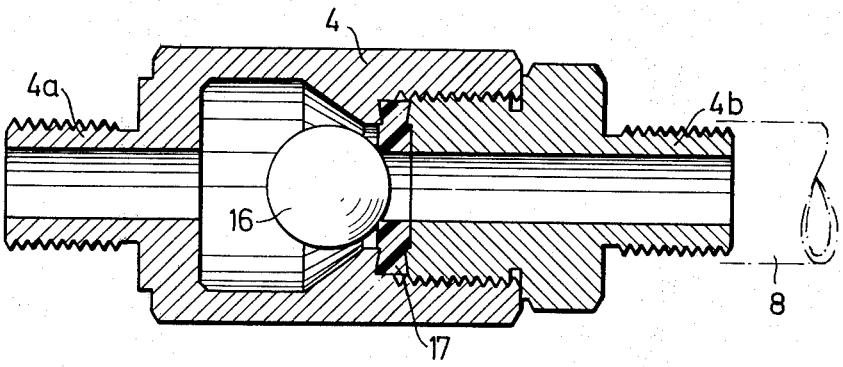
FIGS. 4*a* and 4*b* respectively illustrate in closed and open positions a non-return valve of the invention incorporated into the air-conduit means.
Figure 4B:
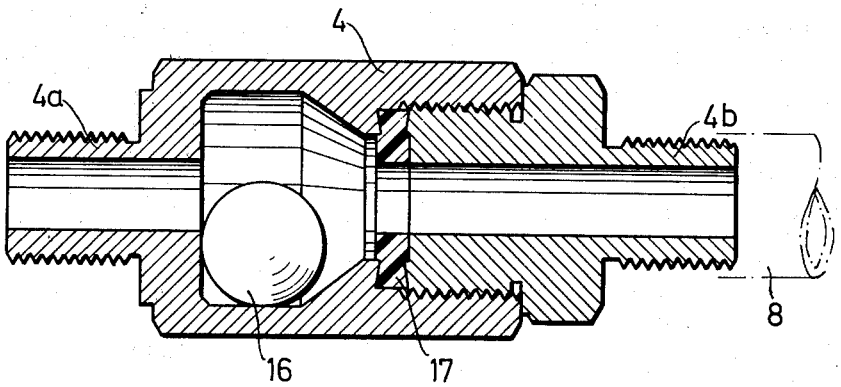

FIGS. 4*a* and 4*b* show the details of the non-return valve means 4 carried by the air-conduit means 8. Thus FIG. 4*a* shows the valve member 16 of the non-return valve means in its closed position engaging the seat 17. The valve has a housing made up of the components 4*a* and 4*b* which are threaded together so as to compress the periphery of the valve seat member 17 in the manner apparent from FIGS. 4*a* and 4*b*. It will be noted that the housing is large enough so that the valve member 16 is capable of falling freely to the position shown in FIG. 4*b* where it is displaced beneath the horizontal axis of the non-return valve means and of course the coinciding axis of the air-conduit means 8. Thus it will be seen that the valve member 16 of the non-return valve means of the invention is not acted upon by any spring and is free to react to gravitational forces in order to assume the position shown in FIG. 4*b* where the valve is open. In response to the flow of fluid, either liquid or air, from the tank 1 toward the tank 2, this fluid will act on the ball member 16 to raise the latter to the closed position of FIG. 4*a* so as to prevent the reverse flow of fluid. Of course the left housing part 4*a* communicates with the tank 1 while the right housing part 4*b* communicates with the tank 2. During transfer of air from the tank 2 to the tank 1 the valve 16 is in the position of FIG. 4*b*, and of course the same is true when in a rest or equilibrium position there is an equality of pressure on both sides of the valve member 16. It will be noted that whenever the pressure-responsive valve means 3 is in the high pressure position of FIGS. 1*b*, 2*b*, or 3*b*, the non-return valve means 4 is in the closed position shown in FIG. 4*a* because of the greater pressure prevailing in the tank 1 at this time. This closed position of the non-return valve means of course prevents any loss of pressure from the tank 1.

Figure 5:
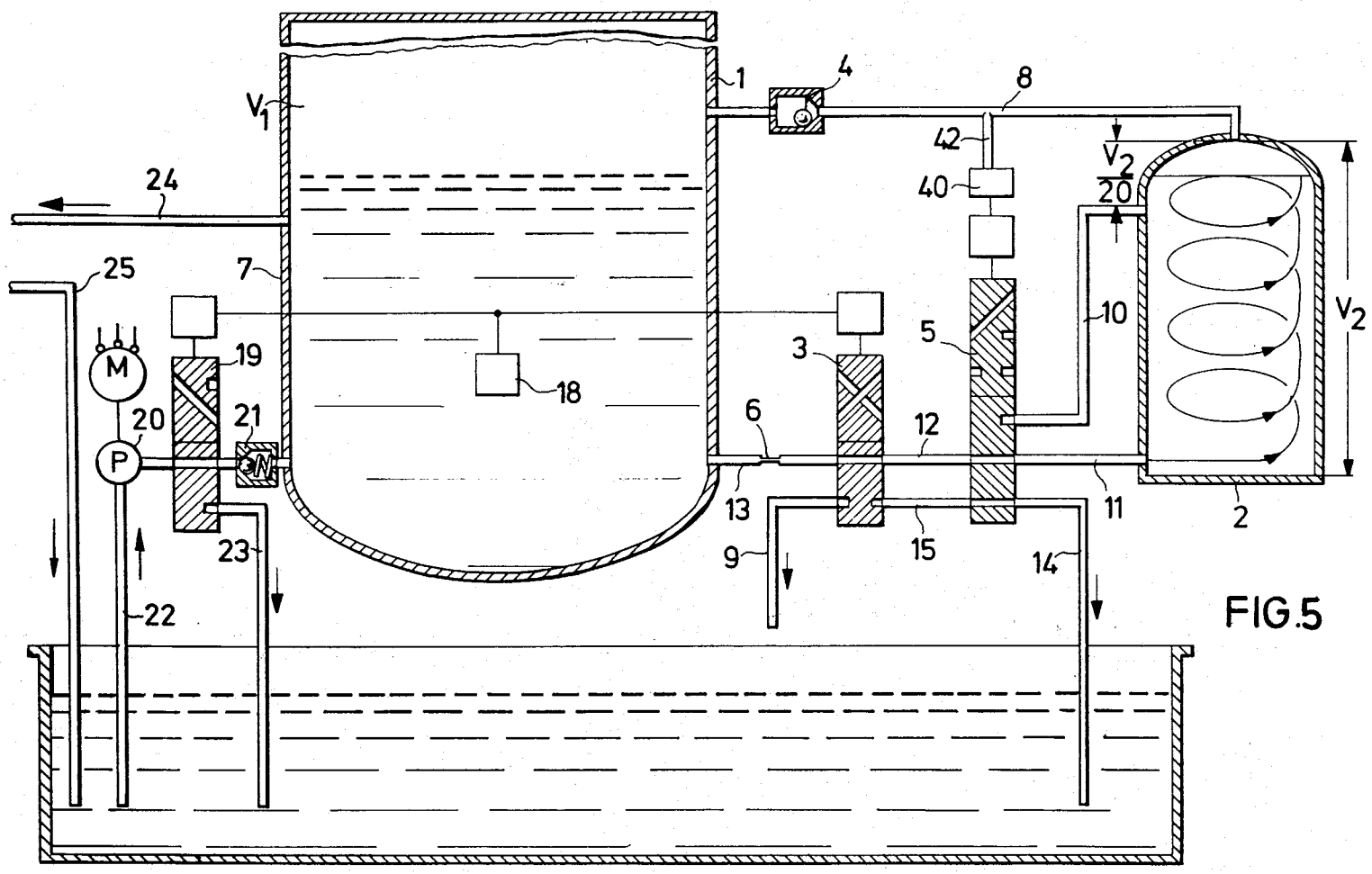
FIG. 5 fragmentarily illustrates in a schematic manner an arrangement as shown in FIGS. 1*a*–2*b*, with FIG. 5 showing further details.

FIG. 5 shows the entire assembly of FIGS. 1*a*–2*b* in a schematic manner where the liquid-supply tank 1 is shown as having the volume $V_1$ while the air-supply tank 2 is shown as having a volume $V_2$, with the pipe portion 10 being connected to the tank 2 so as to provide in the latter above the elevation of the connection of the pipe 10 to the tank 2 a volume which is 1/20 of the total volume $V_2$ of the tank 2. As may be seen from FIG. 5, a pressure-responsive switch 18 is located directly at the tank 1 and is operatively connected with the valve 3 so as to actuate the latter in response to the detection of the upper and lower pressure limits as referred to above. In this particular example the change-over valve means 5 is also shown as an automatically operable valve means which can respond to a signal so as to change from the rapid-cycle position to the normal cycle position as described below. The pressure-responsive switch 18 is connected not only to the valve means 3 but also to a valve means 19 which controls the supply of liquid to the tank 1 by way of a motor driven pump P which supplies liquid under pressure through the non-return valve 21. The parts are shown in FIG. 5 in the position where liquid under pressure is flowing through the conduits 13, 12, and 11 into he tank 2 so as to displace the charge of air out of the latter into the tank 1 through the non-return valve means 4, while simultaneously liquid is pumped into the tank 1 by way of the pump 20 which is driven by the motor M as illustrated. Thus, the parts are shown in FIG. 5 in the low-pressure position of the pressure-responsive valve means 3. As soon as the switch 18 detects that the upper pressure limit has been reached, the valve 3 is operated to provide the high-pressure position where the liquid under pressure flows out of the tank 1 through the discharge pipe 14 to be received in a reservoir as schematically indicated in FIG. 5. It will be noted that the pipe 14 extends beneath the surface of the liquid in the reservoir while the discharge pipe 9 for the air-supply tank 2 terminates above the surface of the liquid in the reservoir so that air can freely bubble up through the pipe 9 as well as the pipes 12 and 11 during that phase of each cycle when liquid flows out of the tank 2 while air flows in in counterflow to the outflowing liquid. At this time, the valve 19 has also been automatically actuated so that the pump 20 pumps liquid directly from the suction conduit 22 to the pressure conduit 23 which returns the liquid back to the reservoir. It is only when the liquid under pressure flows from the tank 1 to the tank 2 in the position of the parts shown in FIG. 5 that the valve 19 has the position illustrated where the pump P delivers the liquid under pressure from the suction conduit 22 into the tank 1. The liquid is taken as required from the tank 1 by way of the conduit 24. For example, in the case of a tank provided to supply drinking water to an apartment house, this water will be derived by way of the pipe 24. The liquid is supplied to the reservoir by way of the pipe 25.

Moreover, in order to achieve an automatic operation of the valve means 5 so as to change the latter over automatically from the rapid cycle position shown in FIG. 5 to the normal cycle position, a counter means is provided to provide a signal after a given number of operating cycles have been counted. Thus, the counter means 40 may communicate through a pipe 42 with the air-conduit means 8. In response to the high pressure in the conduit 8 which is provided at each cycle as the air is compressed in the tank 2 and then transferred to the tank 1, it is possible to actuate, for example, a diaphragm which when distended to a degree determined by the pressure will actuate the counter means 40 so that it will count the particular cycle, and in this way the successive cycles can be counted by the counter means 40. The latter can be set so that when a given number of cycles have been counted an electrical signal is provided by automatic closing of a circuit to act, for example, on a solenoid schematically shown in FIG. 5 beneath the counter means 40, this solenoid, then displacing the changeover valve means 5 to the normal cycle position where the operations as shown in FIGS. 2*a* and 2*b* go forward. The counter means can also be actuated by way of the pressure-responsive swithc 18 pneumatically, hydraulically, or electrically.

Figure 6:
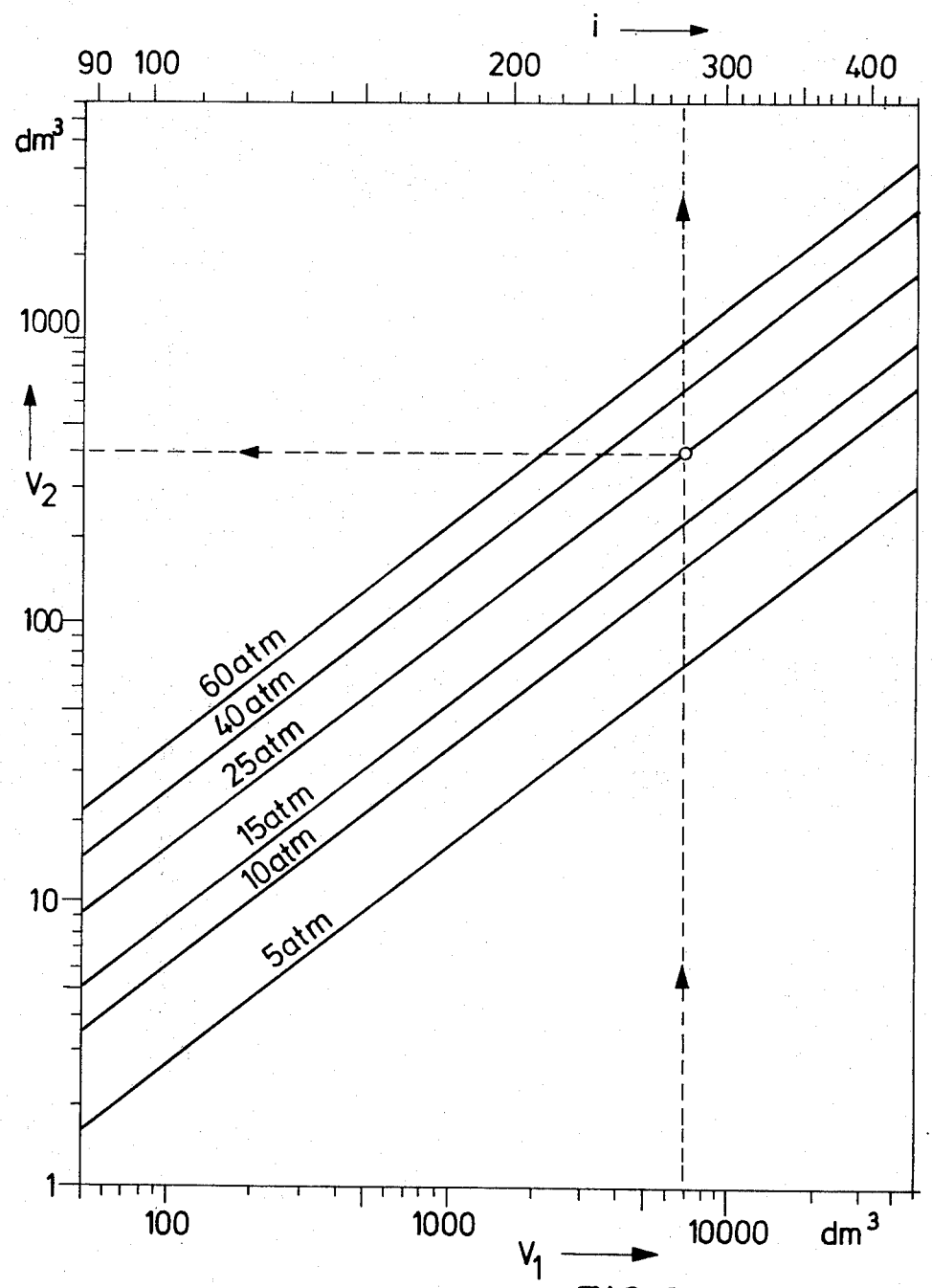
FIG. 6 is a graph illustrating the rapid-cycle operation of an actual construction.

It will thus be seen that with the invention it is possible to rapidly build up the cushion of air over the liquid in the tank 1 within a time which would normally be achieved with a piston type of compressor, but without requiring the use of such compressor. In order to appreciate the magnitudes with which the present invention deals, there is shown in FIG. 6 a graph having logarithmic scales showing the volume $V_1$ of the tank 1 as going up to 50,000 $dm^3$ (13,200 gallons), while the volume $V_2$ of the air-supply tank is shown up to 7,000 $dm^3$. In the particular example illustrated in FIG. 6, it will be seen that a tank volume $V_1$ for the liquid-supply tank of 7,000 $dm^3$(1,850 gallons) is shown with an air cushion therein having a pressure of 25 atmospheres and having a volume of $2/3V_1$ while the air-supply tank $V_2$ is shown as having a volume of 400 $dm^3$ (105 gallons). The number of cycles of operation required during the uninterrupted rapid cycle operation as referred to above in order to provide the air cushion of 25 atmosheres with this particular example is shown at the upper scale *i* where the number of cycles is also shown according to a logarithmic scale. It will be seen that in the illustrated example 275 cycles durinng the rapid cycle operation were required in order to achieve with these particular tanks an air cushion at a pressure of 25 atmospheres. Thus, from the graph of FIG. 6 it is possible to determine the number of rapid operating cycles required to provide a given presssure with liquid-supply and air-supply tanks of given volumes.

In general, each operating cycle will have a duration of approximately 1 minute. Therefore, in the particular example shown in FIG. 6, the 275 cycles require 275 minutes or approximately 4.6 hours. Inasmuch as the compression of the air is calculated on a isothermal basis while actually a polytropic compression takes place, the actual time required to achieve the air cushion of FIG. 6 is shorter.

It is to be noted that by eliminatiing a separate inlet valve for the air-supply tank on the one hand there is no loss of air which is unavoidable with such a valve and on the other hand there is no compressed air between the tank and such an inlet valve so that there is no undesirable dead space.

It is therefore possible with the structure, to achieve disregarding the tangential connections of the pipes to the air-supply tank, an increase in the efficiency of from 26 percent to 84 percent. As a result of the tangential flow of the liquid under pressure into the air-supply tank 2, this efficiency is further increased from 84 percent up to 93 percent. Actual tests have been carried out also with hydraulic oil as the pressure liquid with this oil having a viscosity of 4.5° Engler measured at a temperature of 50° C. 4.5° Engler equals 35 Centistokes. However, much larger installations will be provided in the case of tanks for supplying drinking water to apartment houses, for example. An acutal construction has been provided with the invention utilizing a liquid-supply tank 1 having a volume of 3,700 gallons and having therein an air cushion at a pressure of 25 bar (atmospheres).

Thus, with the present invention when the changeover valve means 5 is in the rapid-cycle position, the cycles will immediately follow one upon the other without any interruption from one cycle to the next. In order to fully appreciate the advantages of the invention, it may be compared with the operations which would be provided without the rapid-cycle operation of the invention. Thus, when with such an arrangement the liquid-supply tank is initially set up or is to have its operations initiated after inspection or repairs, the liquid is supplied to the tank 1 so as to almost completely fill the latter in order to achieve the pressure of, for example, of 25 atmospheres, and the filling to this extent will compress the air during the initial filling so that it occupies approximately 1/26 of the volume of the tank 1. Assuming now that the valve 5 remains only in the normal cycle position, then the tank 1 which has been filled in the above manner is connected only to the installations which will use the tank 1 in the normal manner by withdrawing liquid therefrom as required. In other words, this is the liquid which will flow out through the pipe 24 of FIG. 5. Thus, during normal use of the liquid either for drinking purposes or any other purpose, the pressure in the tank 1 will become reduced to the lower limit which may be set to be approximately 3–5 atmospheres below the upper limit. Thus where the upper limit is 25 atmospheres, the lower limit may be on the order of 20–22 atmospheres. Initially this pressure will fall under these conditions relatively rapidly, and during the first few cycles the pressure will drop fairly rapidly. However, as the volume of the air cushion increases, the time required for the pressure to drop to the lower limit also increases and depending upon how the liquid is taken from the tank during normal use experience has shown that as much as 20 minutes may pass before the pressure drops from the upper limit to the lower limit. Thus, the next cycle for providing further air to the air cushion will under these conditions begin only after a lapse of approximately 20 minutes. Therefore, under these normal operating conditions it may take an entire day until the desired air cushion is established.

On the other hand, with the present invention with the valve 5 in the rapid-cycle position, as soon as the upper pressure limit is reached, the pressure-responsive valve means 3 assumes the high pressure position shown in FIG. 1*b*, so that immediately liquid is emptied from the tank 1 through the discharge pipe 14 while simultaneously liquid is emptying from the tank 2 and a new air charge is flowing into the latter, and as was pointed out above in connection with the example of FIG. 6, the lower pressure limit for starting the next cycle will be rapidly reached so that each cycle requires only a duration of 1 minute. Thus, this rapid drop in pressure from the upper limit to the lower limit which is achieved by way of the present invention enables the operating cycles to follow one after the other without interruption in a rapid sequence so that the air cushion builds up very rapidly within a time which is approximately the same as would be required if a compressor were used.

Of course, during normal operation this rapid cycle type of operation is not desired so that at this time the valve means 5 is changed over to the normal cycle position and the operations go forward in a normal manner only to maintain the air cushion. Of course in this normal position the arrangement of FIGS. 2*a* and 2*b* according to which only a part of the volume of the tank 2 is utilized is of particular advantage since considerable energy is saved in this way. The above-referred to increase of the efficiency up to 93 percent was achieved with the above example of the hydraulic oil having the viscosity of 4.5 E measured at a temperature of 50° C with the pressure of the air cushion being 25 atmospheres.

It is to be noted that it is also of advantage to arrange the inlet end of the air-conduit means 8 at the uppermost part of the tank 2 so as to eliminate any possibility of dead spaces where air under pressure can accumulate without traveling to the tank 1. It is to be noted that the surface of the liquid in the tank 1 automatically remains at a height which is in the region of the outlet of the horizontal conduit means 8 into the tank 1. This is achieved by the non-return valve means 4 situated in the horizontal conduit 8. When equal pressure prevails before and after the valve member 16, it rolls to a location somewhat below the valve axis. If the surface of the liquid in the tank 1 is higher than the valve 4, then when the tank 2 is emptied the ball valve will immediately be driven by the liquid to the closed position shown in FIG. 4*a*. However, where the liquid level is beneath the valve 4, then a small amount of air will flow toward toward the tank 2 when the latter is placed in communication with the outer atmosphere, and this small amount of air will be sufficient to act on the valve member 16 in order to return it to the closed position. In this way there is assurance that the surface of the liquid in the tank 1 will not fall too low in the event that the valve 5 is manually operated and the operator forgets to return the valve 5 from the rapid cycle position to the normal cycle position. Of course the same considerations apply to expansion of the air cushion as a result of heating, such as, for example, a result of exposure to the rays of the sun. Thus, the structure of the invention takes over the function of a compressor and renders the latter unnecessary. Moreover, with the method and apparatus of the invention it is possible not only to maintain the air cushion in the tank 1 at a constant value, but also it is possible to eliminate any excess of air present in the tank 1, and of course this latter advantage cannot be achieved with a compressor.

Furthermore, it is to be noted that the costs involved with the structure of the present invention which operates at the above high efficiency are substantially less than the costs which would be involved if a compressor were required. In addition to expensive controls, including float switches, relays, and protective switches for the stopping and starting of the compressor it is also necessary to provide an air-supply tank with a magnetic valve for bringing about the releasing pressure. Moreover the cylinders of the air compressor and the compressed air provided thereby must be cooled, so that a cooling system, most commonly using cooling water is required, and of course such a cooling system must be controlled and monitored, so that all of these costs inherent in the use of a compressor are eliminated with the present invention.

With the particular example shown in FIG. 6, the counter means 40 will be set to count 275 cycles from the initial filling of the tank. After this number of cycles has been counted, the valve 5 is automatically shifted to its normal cycle position. Therefore, where the counter is used a fully automatic operation is achieved.

What is claimed is:

1. In a system which includes a liquid-supply tank, an air-supply tank, and an air-conduit means connected to and communicating with both of said tanks so that said air-supply tank may be cyclically operated at a given normal cyclical rate for maintaining an air cushion over liquid in the liquid-supply tank during normal operation of the system while the air-supply tank may be operated at a cyclical rate faster than said normal rate to rapidly build up the air cushion in the liquid-supply tank under conditions where the liquid-supply tank is initially installed, or is set up for operation after inspection, repairs, or the like, a pair of lower pipes respectively communicating with both of said tanks and each situated at an elevation lower than said air-conduit means, a liquid-supply tank discharge pipe, an air-supply tank dishcarge pipe, and control valve means having a high pressure position and a low pressure position, said valve means being operatively connected to and communicating with said lower pipes and said discharge pipes for placing said lower pipe of said liquid-supply tank in communication with said liquid-supply tank discharge pipe and said lower pipe of said air-supply tank in communication with said air-supply tank discharge pipe when said valve means is in said high pressure position thereof and for placing said lower pipes in communication with each other while terminating communication between said lower pipes and discharge pipes when said valve means is in said low pressure position thereof.

2. The combination of claim 1 and wherein said control valve means includes a pressure-responsive valve means connected to and communicating with said lower pipe of said liquid-supply tank and responding to upper and lower pressure limits in said liquid-supply tank for assuming said high and low pressure positions, and said control valve means including a change-over valve means connected to and communicating with said lower pipe of said air-supply tank for changing over between a normal cycle position during normal operation of the system and a rapid cycle position during rapid buildup of the air cushion in the liquid-supply tank, and said control valve means further including a valve conduit means connected between and communicating with said pressure-responsive valve means and said change-over valve means, said liquid-supply tank discharge pipe being operatively connected with said change-over valve means and extending therefrom while remaining open downstream of said change-over valve means, the positions of said pressure-responsive valve means and said change-over valve means providing four different operating phases, said pressure-responsive valve means and said change-over valve means together with said valve conduit means cooperating in said high pressure position of said pressure-responsive valve means and said rapid-cycle position of said change-over valve means to place said lower pipe of said liquid-supply tank in communication with said liquid-supply tank dishcarge pipe while cutting off communication between the latter discharge pipe and said liquid-supply tank in the three other operating phases.

3. The combination of claim 2 and wherein said lower pipe of said air-supply tank itself has a lower portion and an upper portion both communicating with said air-supply tank with said lower pipe portion having a lower elevation than said upper pipe portion, and said change-over valve means being operatively connected with both of said pipe portions for providing communication between said lower pipe portion and said valve conduit means when said change-over valve means is in said rapid cycle position thereof while providing communication between said upper pipe portion and said valve conduit means when said change-over valve means is in said normal cycle position thereof.

4. The combination of claim 3 and wherein said air-supply tank is an upright cylindrical tank of circular cross-sectional configuration while said upper and lower portions of said lower pipe of said air-supply tank both communicate tangentially with said air-supply tank.

5. The combination of claim 2 and wherein said pressure-responsive valve means remains connected to and in communication with said lower pipe of said liquid-supply tank in both said high pressure and low pressure position of said pressure-responsive valve means, while said change-over valve means is connected to and communicates with said liquid-supply tank discharge pipe but provides communication between the latter and said valve conduit means only in the rapid cycle position of said change-over valve means.

6. The combination of claim 2 and wherein a counting means is operatively connected with said air-supply tank for counting the number of operating cycles carried out thereby when said change-over valve means is in said rapid cycle position thereof, and automatic means connected between said counting means and said change-over valve means for automatically transferring the latter from said rapid cycle to said normal cycle position thereof after said counting means has counted a given number of operating cycles of said air-supply means.

7. The combination of claim 2 and wherein said liquid-supply tank lower pipe carries a throttle means for providing a time interval required for lowering of the pressure in said liquid-supply tank from said upper limit to said lower limit greater than the time interval required for said air-supply tank to receive a new charge of air.

8. The combination of claim 1 and wherein said liquid-supply tank lower pipe carries a throttle means for throttling the flow of liquid through the latter lower pipe, and the latter lower pipe carrying a means which supports said throttle means for interchange with a different throttle means.

9. The combination of claim 1 and wherein said air-conduit means has a non-return valve means for providing flow of air only from said air-supply tank to said liquid-supply tank, said non-return valve means including a freely movable valve member free to move in response to gravitational forces acting thereon and a housing housing said valve member to provide for the latter a space large enough to permit the valve member to fall to an open position while in response to flow of fluid from said liquid-supply tank toward said air-supply tank said valve member automatically returns to its closed position.

10. The combination of claim 1 and wherein said air-supply tank is entirely closed except for its connection to said air-conduit means and said air-supply tank lower pipe with a new charge of air being received by said air-supply tank through said lower pipe thereof and said air-supply tank discharge pipe simultaneously with the discharge of liquid from said air-supply tank through said lower pipe thereof and said air-supply tank discharge pipe, so that said air-supply tank does not have a separate valve for admitting air and does not have any dead space associated with such a valve.

* * * * *